US008425251B1

(12) United States Patent
Pedruzzi

(10) Patent No.: US 8,425,251 B1
(45) Date of Patent: Apr. 23, 2013

(54) ASSEMBLY FOR RELIEVING CABLE BUNDLE CONNECTION STRAIN

(75) Inventor: Jason Pedruzzi, Wichita, KS (US)

(73) Assignee: GOMA Enterprises, L.L.C., Wichita, KS (US)

( * ) Notice: Subject to any disclaimer, the term of this patent is extended or adjusted under 35 U.S.C. 154(b) by 0 days.

(21) Appl. No.: 13/357,752

(22) Filed: Jan. 25, 2012

(51) Int. Cl.
*H01R 13/58* (2006.01)

(52) U.S. Cl.
USPC ..... 439/470

(58) Field of Classification Search ..... 439/470, 439/471, 464, 460, 607.41
See application file for complete search history.

(56) References Cited

U.S. PATENT DOCUMENTS 8,157,594 B2 * 4/2012 Gilliam ..... 439/607.41
8,262,406 B2 * 9/2012 Lindkamp ..... 439/470

* cited by examiner

*Primary Examiner* — Phuong Dinh
(74) *Attorney, Agent, or Firm* — Kenneth H. Jack; Davis & Jack, LLC

(57) ABSTRACT

An assembly for relieving cable bundle connection strain, the cable bundle being electrically connected to and extending from a multi-terminal modular plug, the assembly including a receptacle receiving the multi-terminal modular plug, the receptacle having a cable receiving nipple; clamping set screws connected operatively to the receptacle's lateral and oppositely lateral walls for securing the multi-terminal modular plug within the receptacle; a cable extension port opening the receptacle, the cable extension port receiving the cable bundle's extension; a cable sheath, the cable bundle's extension being further received by the cable sheath; and a constant force spring annularly clamping the sheath about the receptacle's nipple.

9 Claims, 3 Drawing Sheets

ASSEMBLY FOR RELIEVING CABLE BUNDLE CONNECTION STRAIN

FIELD OF THE INVENTION

This invention relates to modular electrical cable terminal plugs. More particularly, this invention relates to apparatus assemblies and structures relating to such plugs which are adapted for relieving strain, materials fatigue, and breakage at electrode connections of wire conductors extending from such plugs.

BACKGROUND OF THE INVENTION

Modular electrical connectors or plugs (such as an RJ45 ethernet plug or a common telephone plug) commonly comprise a small plastic box housing which presents at a forward end a plurality of electrode contacts, each such contact being housed and supported within an electrode contact slot. In a common embodiment of such modular plug, a plurality of insulated electrical conductors or cable bundle is fixedly attached within and extends rearwardly from the plug, the forward end of each conductor among such cable bundle being attached in electrical communication with one of the electrode contacts which are supported by the modular plug.

Modular plugs such as described above commonly include within their housings' interior spaces clamping means such as an edge of an interior ridge which may exert a compressive holding force against cable bundle and against a housing wall. Such holding force is typically applied within the plug's hollow interior, and at a point immediately rearwardly from the electrical conductors' electrode connections. An intended function of such interior cable bundle clamping means is strain relief. In the event that a rearward pulling force is applied to the cable bundle, such force is ideally directed only against the plug's ridge configured clamping means and housing rather than imposing tension or strain at the plug's electrode contacts. Accordingly, such interior clamping means are intended to protect against translation of excess pulling forces to the electrode contacts, and attempt to prevent breakages and interruptions of electrical communication at the electrode contacts. However, such plugs' interior cable bundle clamping means are typically weak and ineffective, commonly and undesirably allowing such rearward pulling force exerted against the cable bundle to be directly mechanically translated to the electrode contacts, breaking such contacts and ruining the plug.

The instant inventive assembly for relieving cable bundle connection strain solves or ameliorates the problems, defects, and deficiencies discussed above by mechanically associating with a modular plug and cable bundle assembly specially configured receptacle and sheath assembly which mechanically assures that such pulling rearward forces applied to the cable bundle translate to the modular plug housing and socket receiving the plug, rather than allowing electrical connection breaking translations of the pulling force to the cable bundle's electrode connections.

BRIEF SUMMARY OF THE INVENTION

A first structural component of the instant inventive assembly for relieving cable bundle connection strain comprises a receptacle having a hollow and forwardly opening interior space. The receptacle component is preferably fitted for receiving multi-terminal modular plugs such as RJ45 ethernet plugs or common telephone plugs. In the preferred embodiment, the receptacle has a box housing configuration which has an interior lateral dimension slightly greater than an exterior lateral dimension of a largest accommodated multi-terminal modular plug.

A further structural component of the instant inventive assembly comprises first clamping means which are at least connected operatively to the receptacle's lateral wall or oppositely lateral wall. In the preferred embodiment, the first clamping means are adapted for securely holding a multi-terminal modular plug which is received within the receptacle's hollow interior, such means preventing any longitudinal or front/rear slippage of the plug with respect to the receptacle. The first clamping means preferably comprise at least a first externally helically threaded set screw and internally helically threaded socket combination, the socket of such combination preferably further opening the receptacle at its lateral or oppositely lateral wall. Upon the receptacle's receipt of a multi-terminal modular plug, and upon turning of such combination's set screw against a lateral side of the plug, the plug may be advantageously securely clamped and held within the receptacle. Preferably, the first clamping means further comprise a second set screw and helically threaded socket combination whose socket further opens the receptacle oppositely from the at least first combination. In the preferred embodiment, the set screws are configured so that their axial length exceed the thickness dimensions of the receptacle's lateral walls, such excess screw lengths advantageously allow the variously laterally sized modular plugs to be received within and held by the set screws.

A further structural component of the instant inventive assembly comprises a cable extension port which further opens the receptacle. Where a bundle of insulated electrical conductor, or cable bundle extends from a multi-terminal modular plug which is received by the receptacle, such cable extension port preferably receives such cable bundle. Suitably, the cable extension port may be positioned to open the receptacle at the receptacle's back wall. Where differently directed cable extensions are desired, the cable extension port may acceptably alternatively open the receptacle at another of the receptacle's walls such as a lower wall, an upper wall, a lateral wall, or an oppositely lateral wall.

A further structural component of the instant inventive assembly comprises a hollow bored cable sheath, the cable bundle's extension preferably being further received within the sheath bore. In a preferred embodiment, the cable sheath comprises wire braid. Suitably, the cable sheath may be composed of another durable and flexible tube material such as nylon plastic or polythene plastic.

A further structural component of the instant inventive assembly comprises attaching means which are adapted for securely mechanically connecting a forward end of the cable sheath to the receptacle. In operation of the instant invention, and assuming that a multi-terminal modular plug is received within the assembly's receptacle, an operator may manually hold the assembly's cable bundle by applying a grasping force to the outer surfaces of the sheath which contains and protects the cable bundle. Thereafter, upon the operator's application of a rearward pulling force to the combined cable bundle and sheath, such force advantageously mechanically translates from the sheath to the attaching means, then to the receptacle, then to the multi-terminal modular plug through the clamping means, and then to a socket which receives such, all without any electrical connection breaking transfer of force to the modular plug's electrode contacts.

In a preferred embodiment, the sheath's attaching means comprise a hollow bored nipple which is fixedly attached to or is formed wholly with the receptacle, such nipple's bore aligning and communicating with the receptacle's cable extension port. Where attaching means including the preferred nipple are provided, such means preferably further comprise annular clamping means, a preferred annular clamping means comprising a constant force spring (i.e., a Hunter or Negator spirally wrapped rarefaction spring). Suitably, other ring fasteners such as a "Band-it" bands, magnaform rings, heat shrink boots, heat shrink tube fittings, adhesive bonds frapping, and wire whipping may be alternatively utilized as the attaching means which interconnects the cable sheath and the receptacle.

Accordingly, objects of the instant invention include the provision of an assembly for relieving cable bundle connection strain which incorporates structures, as described above, and which arranges those structures in relation to each other, in manners described above, for performance of the beneficial functions described above.

Other and further objects, benefits, and advantages of the present invention will become known to those skilled in the art upon review of the Detailed Description which follows, and upon review of the appended drawings.

DETAILED DESCRIPTION OF A PREFERRED EMBODIMENT

Figure 1:
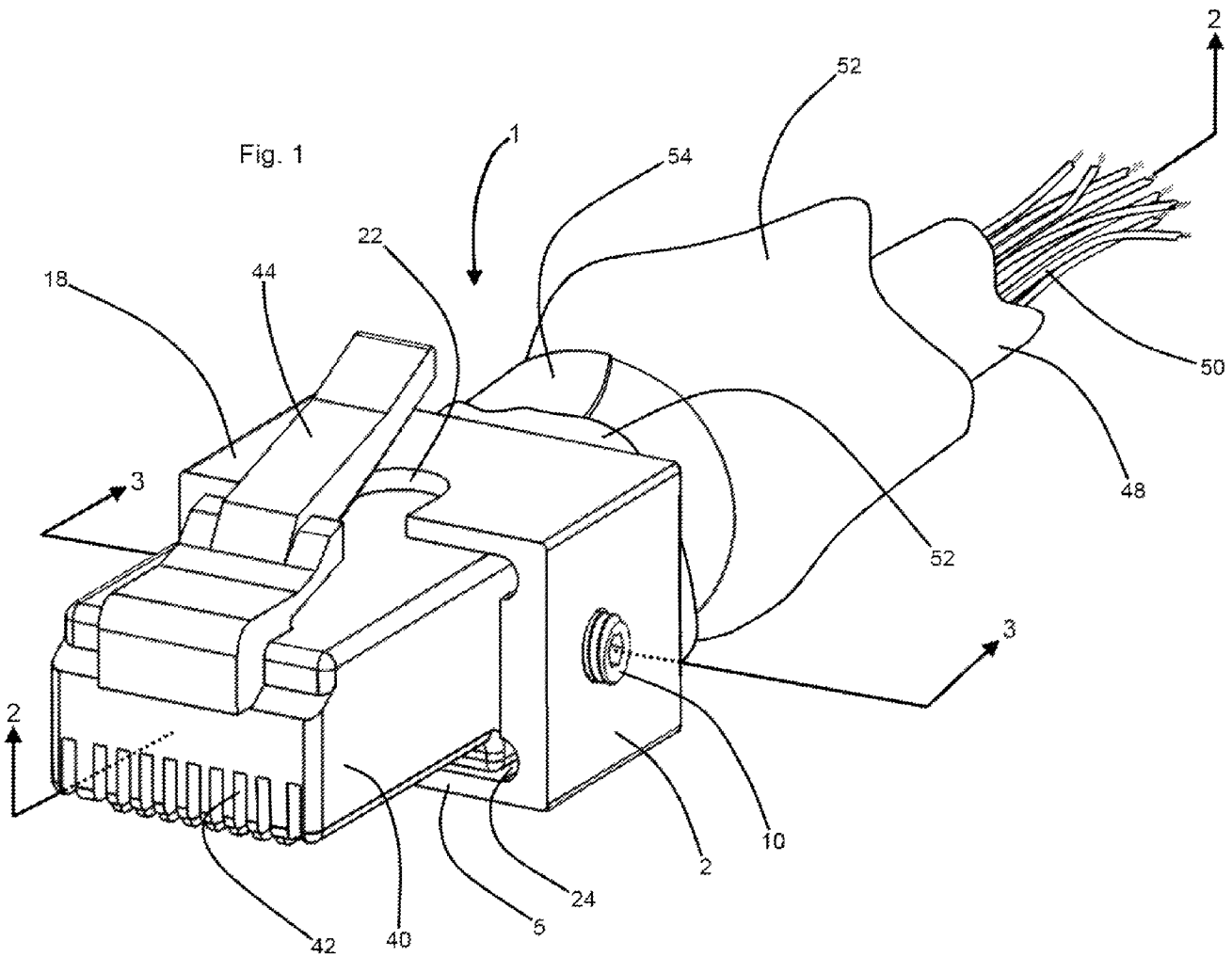
FIG. 1 is a perspective view of a preferred embodiment of the instant inventive assembly for relieving cable bundle connection strain, the view showing successive cable bundle and sheathing layers cutaway for exposure of underlying structures.
Figure 2:
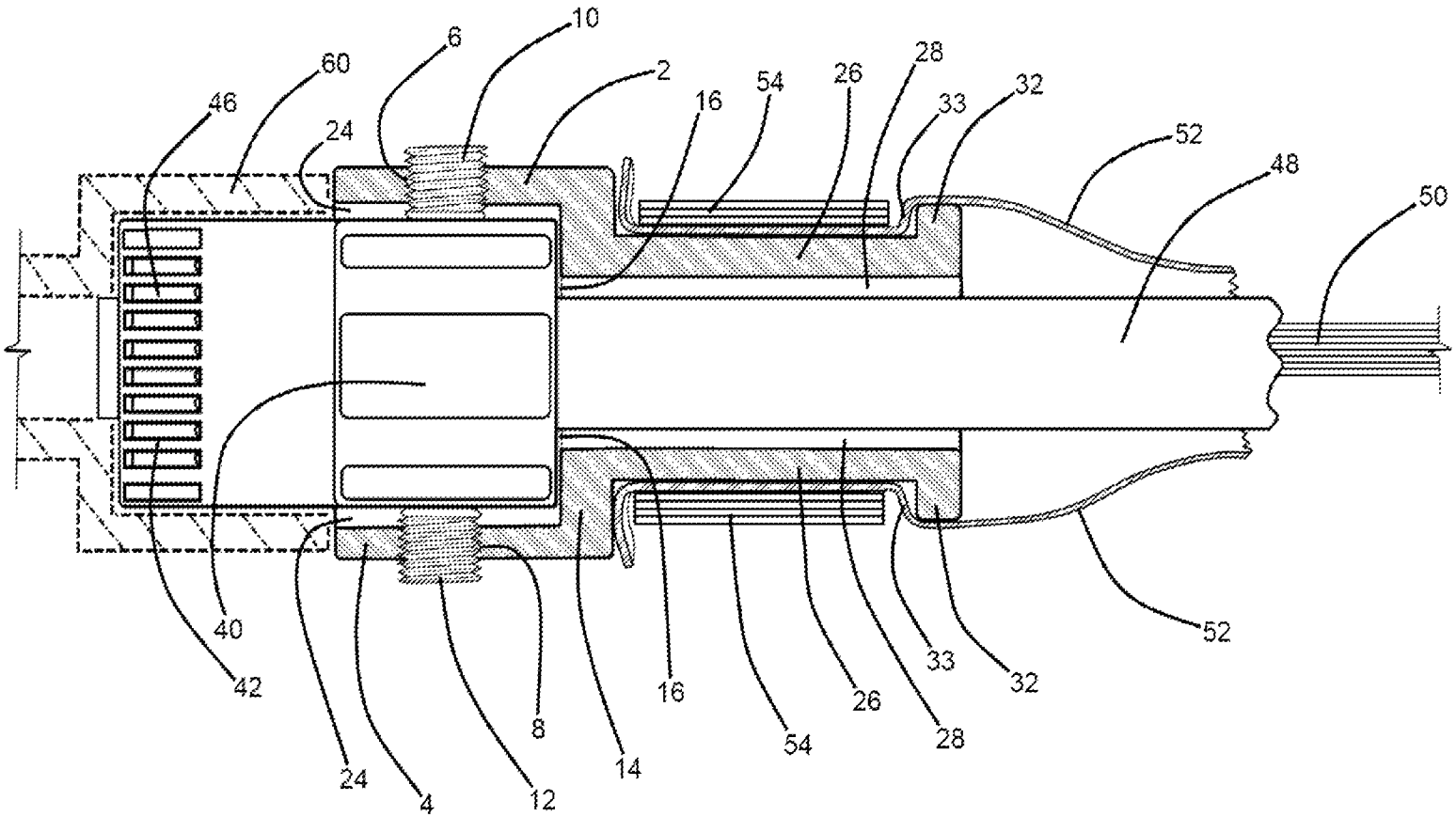
FIG. 2 is a sectional view as indicated in FIG. 1.
Figure 3:
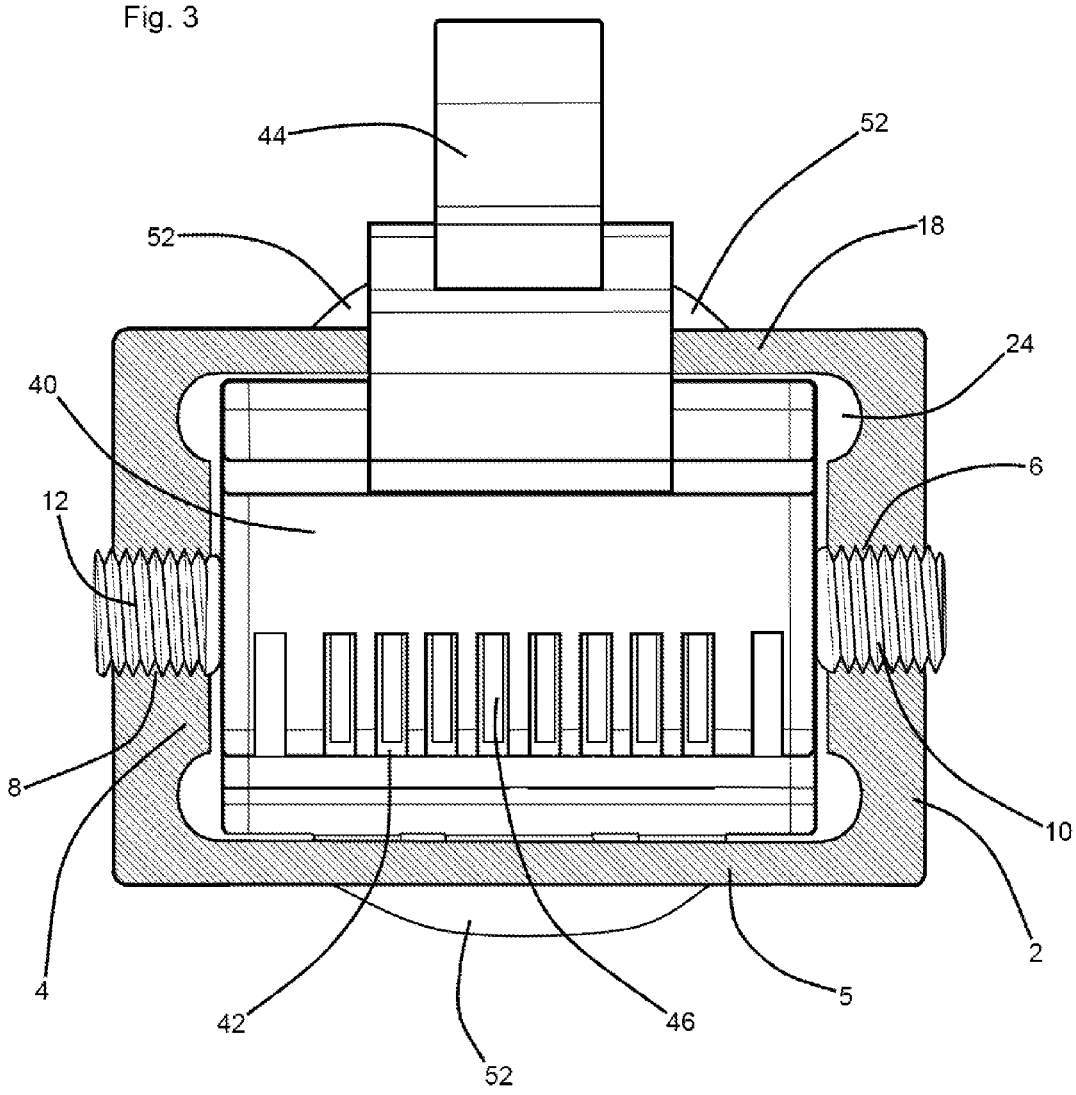
FIG. 3 is an alternative sectional view, also as indicated in FIG. 1.

Referring now to the drawings, and in particular simultaneously to FIGS. 1, 2, and 3, a preferred embodiment of the instant inventive assembly for relieving cable bundle connection strain is referred to generally by Reference Arrow 1. The assembly 1 preferably comprises a forwardly opening receptacle having a hollow interior space 24 which is defined by a lateral wall 2, an oppositely lateral wall 4, an upper wall 18, a lower wall 5, and a back wall 14. As is depicted in FIGS. 1-3, such receptacle preferably has a box housing configuration.

Referring to FIG. 2, a further structural component of the instant inventive assembly preferably comprises first clamping means which are connected operatively to the receptacle for securing a multi-terminal modular plug, such as plug 40, within the receptacle's interior space 24. In the preferred embodiment, the first clamping means comprise at least a first helically threaded socket 6 and helically threaded set screw 10 combination, such socket 6 opening the receptacle at one of the receptacle's lateral or oppositely lateral walls 2 or 4. In operation of the first clamping means, an allen wrench may be applied to the set screw 10, turning such screw clockwise and driving the inner end of such screw against the lateral side of plug 40. Such screw driving force in turn drives the oppositely lateral side of the plug 40 against an oppositely lateral structure such as oppositely lateral receptacle wall 4, securely clamping and holding the plug 40 within space 24.

In the preferred embodiment, the first clamping means further comprise a second helically threaded socket 8 and set screw 12 combination, such combination preferably being positioned oppositely from the at least first helically threaded socket 6 and set screw 10 combination. As can be seen in FIG. 3, the lateral dimension of the plug 40 is less than the lateral dimension of the interior space 24 of the receptacle. The inward extensions of set screws 10 and 12 effectively span such differential in lateral dimensions, and sizing the set screws 10 and 12 so that they may span such lateral dimension differentials advantageously allows them to dually function as means for securing a selected plug 40 within space 24, and for alternatively accommodating other differently laterally sized modular plugs.

Referring to FIG. 2, a further structural component of the instant inventive assembly comprises a cable extension port 16 which further opens the receptacle. As depicted in FIG. 2, the cable extension port 16 may suitably further open the receptacle at the receptacle's back wall 14. Alternatively (and upon a reconfiguration of the receptacle to extend its upper, lower, lateral, and oppositely lateral walls rearwardly beyond the rearward end of plug 40, such reconfiguration not being shown within views), the cable extension port 16 may suitably be alternatively positioned at one of such other receptacle walls. Upon such alternative positionings of the receptacle's cable extension port, the "straight line" plug and receptacle configuration depicted in FIGS. 1-3 may advantageously assume a 90° turn configuration wherein the cable bundle is turned at such angle in relation to the plug.

A cable bundle including a plurality of electrically conductive and insulated wires 50, and a sleeve 48 receiving such wires, is fixedly attached to and extends rearwardly from the multi-terminal modular plug 40. In the preferred embodiment of the instant inventive assembly 1, the receptacle's cable extension port 16 receives such cable bundle's rearward extension, such extension passing through such port.

Referring to FIG. 2, a further structural component of the instant inventive assembly comprises a flexible cable sheath 52, the rearward extension of cable bundle 48,50 being further received by such sheath.

Referring simultaneously to all figures, the instant inventive assembly 1 preferably further comprises attaching means which are adapted for securely and fixedly interconnecting the forward end of the sheath 52 and the receptacle 2,4,5,14, 18. In a preferred embodiment, the attaching means comprise a cylindrical nipple 26 having a follow bore 28. Such nipple is preferably positioned with respect to the receptacle so that the bore 28 overlies and communicates with the receptacle's cable extension port 16. Upon such positioning, the nipple's bore 28, like the sheath 52 and port 16, may receive the rearward extension of the cable bundle 48,50. Where such nipple 26 is provided, the attaching means preferably further comprise second clamping means for, upon extension of the forward end of the sheath 52 over the nipple's outer circumferential surface, annularly clamping the sheath 52 about and against such surface. In a preferred embodiment, a spirally wrapped constant force spring (i.e., a Hunter or Negator spring) 54 annularly clamps the forward end of the sheath about nipple 26 and within the annular channel which is respectively forwardly and rearwardly defined by the rearward face of the receptacle's rear wall 14 and an annular flange 32 which is fixedly attached to or formed wholly with the nipple's distal end. Where the attaching means comprise an annular flange 32, such flange advantageously operates in conjunction with the constant force spring 54 by producing an annular sheath securing binding bend 33 between the spring 54 and the flange 32.

The preferred nipple 26, flange 32, and constant force spring 54 attaching means is considered to be representative of other suitably and alternatively utilized attaching means, including "Band-it" bands or other ring binder fastening assemblies such as magnaform rings, heat shrink bands, heat shrink boots, and adhesive bonds (none depicted in the drawings).

Referring to FIGS. 1 and 2, in an unprotected use of plug 40 and cable bundle 48,50 (i.e., in absence of provision and utilization of the instant inventive assembly) the multi-terminal modular plug 40 may be inserted into the multi-terminal socket 60 which is represented in dashed lines. Upon such insertion, a spring latch 44 component of plug 40 typically hookingly engages an edge surface within socket 60 for securing the plug 40 within the socket. Also, upon such plug insertion, electrode contacts within the socket 60 (not depicted within views) enter channels 42 within the forward end of plug 40 for establishment of a series of electrical connections with electrode contacts 46 which are supported within the channels 42. In such unprotected use of plug 40 and cable bundle 48,50, an operator may either intentionally or accidentally apply an excessively strong rearward pulling force to the cable bundle 48,50, and such force may undesirably break some or all of the electrical connections which are necessarily maintained within the plug 40 between the forward ends of the insulated electrical wires 50 and the plug's electrode contacts 46. Accordingly, such pulling force may undesirably destroy or ruin the modular plug 40.

According to the operation of the instant invention, referring simultaneously to all figures, the receipt by the sheath 52 of the rearward extension of the cable bundle 48,50 advantageously prevents the above described excessive rearward pulling force from being directed exclusively against the cable bundle 48,50. Instead, such pulling force is also applied in a substantially simultaneous mechanical sequence to the sheath 52, to the nipple 26 and constant force spring 54 attaching means, to the receptacle and first clamping means 6,10,8,12, to the modular plug 40 and its spring latch 40, and finally to the socket 60. Such mechanical translation of force is advantageously isolated from the electrical connections between the modular plug's electrode contacts 46 and the forward ends of the conductors 50. Through such force isolation, the instant inventive assembly advantageously minimizes the pulling force which is applied to the electrode contacts, advantageously preventing damage to or destruction of the modular plug 40.

While the principles of the invention have been made clear in the above illustrative embodiment, those skilled in the art may make modifications in the structure, arrangement, portions and components of the invention without departing from those principles. Accordingly, it is intended that the description and drawings be interpreted as illustrative and not in the limiting sense, and that the invention be given a scope commensurate with the appended claims.

I claim:

1. An assembly for relieving cable bundle connection strain, the cable bundle being electrically connected to and extending from a multi-terminal modular plug, said plug having lateral and oppositely lateral sides, said assembly comprising:

(a) a receptacle receiving the multi-terminal modular plug, the receptacle having lateral and oppositely lateral walls;

(b) first clamping means connected operatively to the receptacle's lateral and oppositely lateral walls, the first clamping means being adapted for securing the multi-terminal modular plug within the receptacle;

(c) a cable extension port opening the receptacle, the cable extension port receiving the cable bundle's extension;

(d) a cable sheath, the cable bundle's extension being further received by the cable sheath; and (e) attaching means interconnecting the receptacle and the sheath.

2. The assembly of claim 1 wherein the receptacle comprises a box housing.

3. The assembly of claim 2 wherein the first clamping means comprise at least a first set screw and helically threaded socket combination, said combination's helically threaded socket further opening the receptacle at the receptacle's lateral or at the receptacle's oppositely lateral wall.

4. The assembly of claim 3 wherein the first clamping means further comprise a second set screw and helically threaded socket combination, said combination being positioned oppositely from the at least first set screw and helically threaded socket combination.

5. The assembly of claim 4 wherein the receptacle further has an upper wall, a lower wall, and a back wall, the cable extension port being positioned at a wall selected from the group consisting of the receptacle's back wall, the receptacle's lower wall, the receptacle's lateral wall, the receptacle's oppositely lateral wall, and the receptacle's upper wall.

6. The assembly of claim 5 wherein the attaching means comprise a hollow bored nipple fixedly attached to or formed wholly with the receptacle, the nipple's hollow bore opening at the receptacle's cable extension port, and the cable bundle's extension being further received by the nipple's hollow bore.

7. The assembly of claim 6 wherein the nipple has an outer circumferential surface and wherein the attaching means further comprise second clamping means adapted for, upon a receipt of the nipple within the sheath, annularly clamping the sheath against the nipple's outer circumferential surface.

8. The assembly of claim 7 wherein the attaching means' second clamping means comprise a constant force spring.

9. The assembly of claim 8 wherein the nipple has a distal end, and wherein the attaching means further comprise an annular sheath binding flange fixedly attached to or formed wholly with the distal end.

* * * * *